US011188012B2

(12) United States Patent
Hatazaki et al.

(10) Patent No.: US 11,188,012 B2
(45) Date of Patent: Nov. 30, 2021

(54) COOLING DEVICE, IMAGE FORMING APPARATUS AND IMAGE FORMING SYSTEM

(71) Applicant: Canon Kabushiki Kaisha, Tokyo (JP)

(72) Inventors: Kazunari Hatazaki, Ibaraki (JP); Hironobu Konno, Ibaraki (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 17/113,656

(22) Filed: Dec. 7, 2020

(65) Prior Publication Data

US 2021/0088946 A1 Mar. 25, 2021

Related U.S. Application Data

(63) Continuation of application No. PCT/JP2019/023389, filed on Jun. 6, 2019.

(30) Foreign Application Priority Data

Jun. 8, 2018 (JP) ..... JP2018-110727
May 20, 2019 (JP) ..... JP2019-094688

(51) Int. Cl.
*G03G 15/20* (2006.01)
*G03G 15/00* (2006.01)
*G03G 21/20* (2006.01)

(52) U.S. Cl.
CPC ..... *G03G 15/2017* (2013.01); *G03G 15/6573* (2013.01); *G03G 15/70* (2013.01);
(Continued)

(58) Field of Classification Search
CPC ..... G03G 15/2017; G03G 15/6573; G03G 15/70; G03G 21/20; G03G 2215/00421; G03G 2215/00548; G03G 2221/1675
(Continued)

(56) References Cited

U.S. PATENT DOCUMENTS 6,374,063 B1 * 4/2002 Todome ..... G03G 15/6573 399/18
6,985,677 B2 * 1/2006 Yamagata ..... H04N 1/32609 399/18
(Continued)

FOREIGN PATENT DOCUMENTS

JP 2002357990 A * 12/2002
JP 2007-041025 A 2/2007
(Continued)

OTHER PUBLICATIONS

International Search Report and Written Opinion, dated Aug. 13, 2019, in International Application No. PCT/JP2019/023389.

*Primary Examiner* — Robert B Beatty
(74) *Attorney, Agent, or Firm* — Venable LLP

(57) ABSTRACT

With stoppage of recording material feeding including a first belt and a second belt (YES in S1), a controller causes cooling operation for the recording material by a cooling fan and a belt fan to continue without stop (S4). By continuing the cooling operation of a recording material cooling device, even if the recording material stagnates in the recording material cooling device in a state of being nipped by the first belt and the second belt, the temperature of the recording material can be lowered. Then, the toner on the recording material is cooled, the toner on the recording material is unlikely to adhere to the first belt or to the second belt.

12 Claims, 10 Drawing Sheets

(52) U.S. Cl.
CPC . *G03G 21/206* (2013.01); *G03G 2215/00548* (2013.01); *G03G 2221/1675* (2013.01)

(58) Field of Classification Search
USPC ..... 399/21, 341
See application file for complete search history.

(56) References Cited

U.S. PATENT DOCUMENTS

| | | | | |
|---|---|---|---|---|
| 7,437,085 | B2 * | 10/2008 | Nakagawa | G03G 15/6573 399/122 |
| 8,929,794 | B2 | 1/2015 | Hatazaki | 399/341 |
| 9,075,355 | B2 | 7/2015 | Chiyoda et al. | G03G 15/2025 |
| 9,207,602 | B2 | 12/2015 | Hatazaki | G03G 15/2064 |
| 9,217,964 | B2 | 12/2015 | Hatazaki | G03G 15/2025 |
| 9,310,723 | B2 | 4/2016 | Hatazaki | G03G 15/2025 |
| 9,329,534 | B2 | 5/2016 | Hatazaki | G03G 15/2025 |
| 9,454,111 | B2 | 9/2016 | Hatazaki | G03G 15/2025 |
| 2007/0025751 | A1 | 2/2007 | Nakagawa et al. | |
| 2014/0308057 | A1 | 10/2014 | Tomino | |
| 2014/0327207 | A1 | 11/2014 | Nakagaki | |
| 2020/0285193 | A1 | 9/2020 | Hatazaki | G03G 15/6573 |
| 2020/0387092 | A1 | 12/2020 | Hatazaki | G03G 15/2025 |
| 2020/0387093 | A1 | 12/2020 | Hatazaki | G03G 15/2025 |
| 2021/0072699 | A1 | 3/2021 | Inoue et al. | G03G 15/2017 |

FOREIGN PATENT DOCUMENTS

| | | | | |
|---|---|---|---|---|
| JP | 2011123254 | A | * | 6/2011 |
| JP | 5272424 | B2 | | 8/2013 |
| JP | 2014-206614 | A | | 10/2014 |
| JP | 2014-232303 | A | | 12/2014 |
| JP | 2017-173774 | A | | 9/2017 |

* cited by examiner

COOLING DEVICE, IMAGE FORMING APPARATUS AND IMAGE FORMING SYSTEM

CROSS-REFERENCE TO RELATED APPLICATIONS

This application is a continuation of International Patent Application No. PCT/JP2019/023389, filed Jun. 6, 2019, which claims the benefit of Japanese Patent Application No. 2018-110727, filed Jun. 8, 2018, and Japanese Patent Application No. 2019-094688, filed May 20, 2019. The foregoing applications are incorporated herein by reference in their entireties.

FIELD OF THE INVENTION

The present invention relates to a cooling device which cools a recording material on which an image is formed by an electrophotographic process.

BACKGROUND OF THE INVENTION

In the electrophotographic image forming apparatus, a toner image formed on a recording material such as paper is heated and pressed by the fixing apparatus to fix the toner image on the recording material.

The toner image is fixed by sandwiching and transporting the recording material between the fixing roller heated by a heater or the like and the pressure roller which is press-contacted to the fixing roller. Since the recording material is heated when the toner image is fixed, the temperature of the recording material fed from the fixing device tends to be higher than that before being subjected to the fixing operation. And, after the toner image is fixed, as a large number of recording materials fed at a temperature higher than a predetermined temperature are stacked on the stacking portion, the stacked recording materials may stick to each other due to the toner. A cooling device for cooling the recording material after the toner image is fixed is provided, in order to lower the temperature of the recording material which is fed from the fixing device, to a predetermined temperature or lower after the toner image is fixed, thus suppressing the sticking of the recording material (Japanese Patent No. 5272424). In the cooling device described in Japanese Patent No. 5272424, one of a pair of feed belts which sandwich and feed the recording material transported from the fixing device is cooled by a heat sink, and the temperature of the recording material is lowered by way of the cooled feed belt. This is a belt cooling type device. In addition, the cooling device is provided with a cooling fan for cooling the heat sink for the purpose of performing more efficient cooling.

SUMMARY OF THE INVENTION

Problem to be Solved

By the way, in the image forming apparatus, during the image forming operation, a so-called jam may occur in which the recording material being fed is jammed in the feeding path. When the jamming occurs, the image forming apparatus stops the feed of the recording material by the pair of feed belts in the cooling device, but at that time, the recording material which stays in the cooling device in the state of being sandwiched between the feed belts. Further, when a jam occurs, the cooling fan is also stopped, so that the temperature of the recording material staying while being sandwiched between the pair of feed belts is unlikely to drop. If the temperature of the recording material does not drop, the toner on the recording material remains in the melted state, and the toner may adhere to the feed belt. The toner adhering to the feed belt in this manner adheres back to the recording material during the image forming operation after the jam is cleared, with the result of an image defect.

The present invention has been made in view of the above problems, and an object of the present invention is to provide an image forming apparatus capable of suppressing the toner on the recording material staying in the cooling device from adhering to the belt when the feed of the recording material is stopped.

Means for Solving the Problem

According to the present invention, there is provided a cooling device for cleaning a recording material passed through a fixing portion, said cooling device being usable with an image forming system including the fixing portion for fixing, on a recording material, a toner image formed by an image forming portion by heating the toner image, said cooling device comprising a feeding belt; a feeding unit cooperative with said feeding belt to nip and feed a recording material; a cooling unit for cooling said feeding belt; and a controlling unit capable of executing a feed control for controlling feeding of the recording material effected by said feeding belt and said feeding unit and a cooling control for said feeding belt by said cooling unit, wherein said controlling unit stops the feed control upon occurrence of abnormal feeding of the recording material in a feeding path of said image forming system, and when the recording material is nipped by said feeding belt and said feeding unit for which the feed control is stopped, said controlling unit continues the cooling control.

Effect of the Invention

According to the present invention, it is possible to prevent the toner on the recording material staying in the cooling device from adhering to the feeding belt when the feeding of the recording material is stopped.

EMBODIMENTS OF THE INVENTION

Embodiment 1

<Image Forming Apparatus>

A schematic structure of an image forming apparatus of this embodiment will be described referring to FIGS. 1 and 2.

Figure 1:
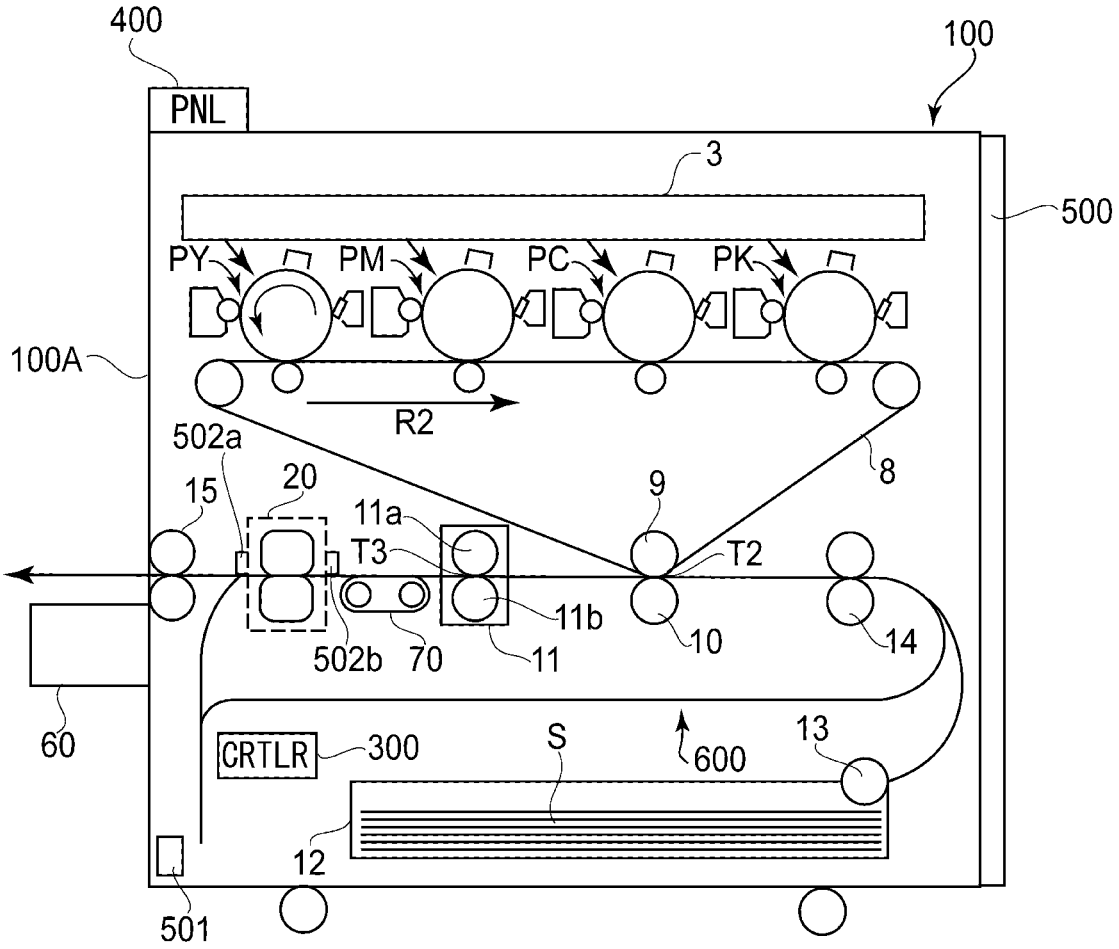
FIG. 1 is a schematic view illustrating a structure of an image forming apparatus of the present embodiment.

The image forming apparatus 100 shown in FIG. 1 is an electrophotographic tandem type full color printer.

The image forming apparatus 100 includes image forming units PY, PM, PC, and PK which form images of yellow, magenta, cyan, and black, respectively.

The image forming apparatus 100 forms a toner image on the recording material in accordance with an image signal from an external device such as an original reading device (not shown) connected to the apparatus main assembly 100A or a personal computer communicably connected to the apparatus main assembly 100A. Form in S. Examples of the recording material S include various types of sheet materials such as plain paper, thick paper, rough paper, uneven paper, coated paper and the like, plastic film, cloth and the like.

As shown in FIG. 1, the image forming portions PY, PM, PC, and PK are arranged side by side in the apparatus main assembly 100A (inside the apparatus main assembly) along a moving direction of an intermediary transfer belt 8.

The intermediary transfer belt 8 is stretched around a plurality of rollers and is structured to travel in the direction of arrow R2.

Then, the intermediary transfer belt 8 carries and conveys a primarily transferred toner image. A secondary transfer roller 10 is provided at a position opposite to the roller 9 on which the intermediary transfer belt 8 is stretched so as to sandwich the intermediary transfer belt 8, and the secondary transfer roller 10 transfers the toner image on the intermediary transfer belt 8 to the recording material S, by which the transfer unit T2 is constituted. A fixing device 11 is provided downstream of the secondary transfer unit T2 in the recording material feed direction.

A cassette 12 containing the recording material S is provided below the image forming apparatus 100. The recording material S is fed from the cassette 12 to a registration roller 14 by a feeding roller 13 along a feeding path 600 forming a path of the recording material S in the apparatus main assembly 100A. Thereafter, the registration roller 14 starts rotating in synchronization with the toner image formed on the intermediary transfer belt 8 as will be described hereinafter, so that the recording material S is fed along the transfer path 600 to the secondary transfer unit T2. Although only one cassette 12 is shown here, a plurality of cassettes 12 may be arranged so as to accommodate recording materials S including different sizes and thicknesses. In such a case, the recording material S is selectively transported to the feed path 600 from a cassette selected from the plurality of cassettes 12.

Further, not only the recording material S accommodated in the cassette 12 but also the recording material S placed on the manual feed feeding unit (not shown) may be transported to the feed path 600.

In addition, the apparatus main assembly 100A is provided with a door 500.

In the case of this embodiment, the door 500 is provided so as to be swingable with respect to the apparatus main assembly 100A, and in an example, it moves about a right end portion such that the left end portion draw an arc in the Figure to open and close (i.e., a single door). FIG. 1 shows a state in which the door 500 is closed. The device main assembly 100A is provided with an open/close sensor 501 as a door detecting means in order to detect the open/closed state of the door 500. By opening the door 500, the user can access the image forming portions PY to PK, the fixing device 11, a recording material cooling device 20, the feed path 600, and the like in the apparatus main assembly 100A from the outside. For example, when the recording material S stagnates in the feed path 600 including the inside of the recording material cooling device 20 (in the feed path), the user can remove the recording material which stays in the recording material cooling device 20 or the feed path 600 by opening the door 500. The number of doors 500 is not limited to one, and a plurality of doors may be provided so as to be independently openable and closeable. In this embodiment, the structure in which the door 500 is provided on the right side of the apparatus main assembly 100A will be described as an example, but a structure in which a door which can be opened and closed is provided on the front side of the device main assembly 100A may be employed.

<Image Forming Portion>

The four image forming units PY, PM, PC, and PK included in the image forming apparatus have substantially the same structure except that the colors of development are different. Here, therefore, the image forming unit PK will be described as a representative, and the other image forming units PY, PM, and PC will be omitted.

Figure 2:
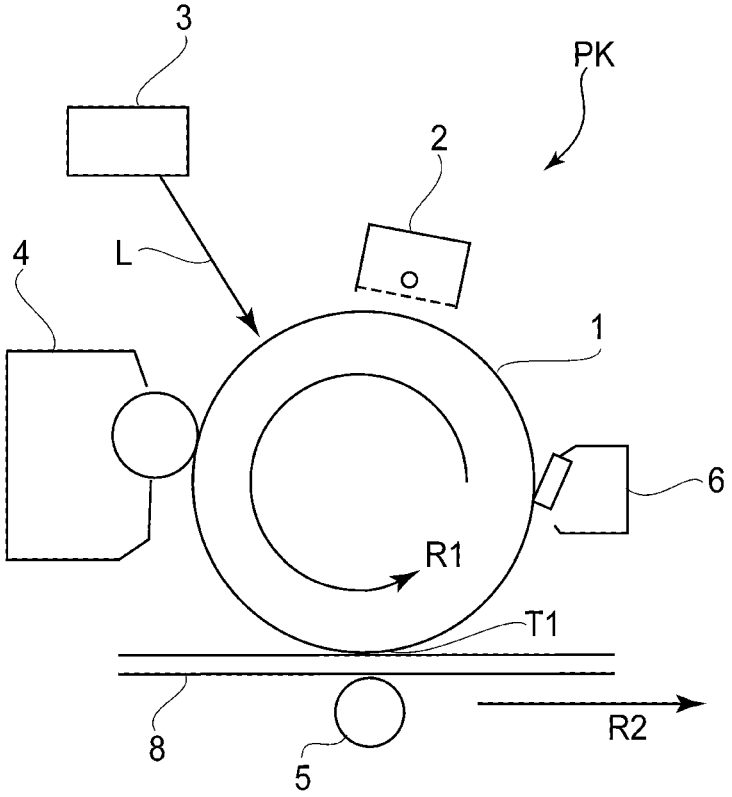
FIG. 2 is a schematic view illustrating an image forming portion.

As shown in FIG. 2, a cylindrical photosensitive drum 1 is provided as a photosensitive member in the image forming portion PK. The photosensitive drum 1 is rotationally driven in the direction of arrow R1. A charging device 2, an exposure device 3, a developing device 4, a primary transfer roller 5, and a cleaning device 6 are arranged around the photosensitive drum 1.

The process of forming a full-color image, for example, by the image forming apparatus 100 will be described. First, when the image forming operation is started, the surface of the rotating photosensitive drum 1 is uniformly charged by the charging device 2. The charging device 2 is a corona charging device, for example, which applies the charged particles produced by corona discharge to charge the photosensitive drum 1 to a uniform negative dark potential. Next, the photosensitive drum 1 is scanned and exposed with the laser beam L corresponding to the image signal emitted from the exposure device 3. By this, an electrostatic latent image corresponding to the image signal is formed on the surface of the photosensitive drum 1. The electrostatic latent image formed on the photosensitive drum 1 is visualized by the toner (developer) contained in the developing device 4 and becomes a visible image.

The toner image formed on the photosensitive drum 1 is primarily transferred onto the intermediary transfer belt 8 by the primary transfer unit T1 formed between the drum and the primary transfer roller 5 arranged with the intermediary transfer belt 8 interposed therebetween. At this time, a primary transfer bias voltage is applied to the primary transfer roller 5. The toner remaining on the surface of the photosensitive drum 1 after the primary transfer is removed by the cleaning device 6.

Such an operation is sequentially performed by the yellow, magenta, cyan, and black image forming portions PY to PK, and the toner images of four colors are superimposed on the intermediary transfer belt 8. Thereafter, the recording material S in the cassette 12 is fed to the secondary transfer unit T2 at the timing of forming the toner image. Then, by applying the secondary transfer bias voltage to the secondary transfer roller 10, the full-color toner image formed on the intermediary transfer belt 8 is collectively secondarily transferred onto the recording material S.

Next, the recording material is fed to the fixing device 11. The fixing device 11 includes a rotatable fixing roller 11*a* and a pressure roller 11*b* which rotates while being in pressure contact with the fixing roller 11*a*. The fixing roller 11*a* is rotated at a predetermined rotation speed (400 mm/sec, for example) by a drive motor (not shown) in a state of being in pressure contact with the pressure roller 11*b*. A halogen heater (not shown) is arranged in the fixing roller 11*a*, and the fixing device 11 can heat the recording material S by raising the surface temperature of the fixing roller 11*a* by the halogen heater.

Figure 3:
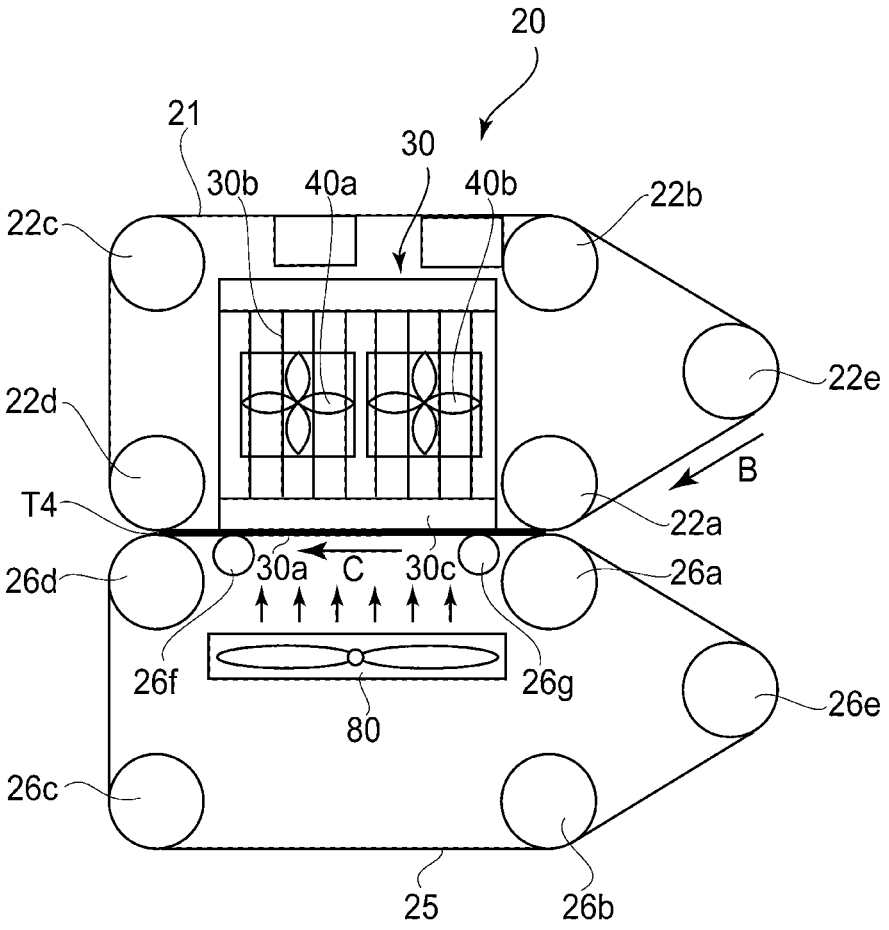
FIG. 3 is a schematic view illustrating a recording material cooling device.

The fixing device 11 heats and presses the recorded material S by sandwiching and transporting the recording material S on which the toner image is formed in the fixing nip T3 formed by the fixing roller 11*a* and the pressure roller 11*b*, so that the toner image is fixed on the recording material S. That is, the toner of the toner image formed on the recording material S is melted and mixed by heating and pressing, and fixed on the recording material S as a full-color image. In this manner, the series of image formation processes is completed. Then, the recording material S on which the toner image is fixed is air-attracted, for example, by the feed device 70 and transported to the recording material cooling device 20. The recording material cooling device 20 as a cooling device cools the recording material S. The recording material cooling device 20 will be described hereinafter (FIG. 3).

In this embodiment, in order to detect the stagnation of the recording material S in the recording material cooling device 20, it is detected whether or not the recording material S has passed through an inlet and an outlet of the recording material cooling device 20 in the feed path 600, passage sensors 502*a* and 502*b*.

In addition, the image forming apparatus 100 of this embodiment is capable of forming doublesided print.

In the case of single-sided printing, the recording material S cooled by the recording material cooling device 20 is discharged to the outside of the device main assembly 100A (outside the device main assembly) by the paper discharging roller 15. On the other hand, in the case of double-sided printing, the recording material S cooled by the recording material cooling device 20 is inverted in the feed path 600, so that the front surface and the back surface of the recording material S are interchanged. The inverted recording material S is fed along the transportation path 600 toward the registration roller 14, and is transported to the secondary transfer portion T2 with the back-surface side not printed by the registration roller 14 facing the intermediary transfer belt 8. In the secondary transfer unit T2, the full-color toner image formed on the intermediary transfer belt 8 is collectively transferred onto the recording material S (back surface side). Thereafter, the toner image is fixed on the recording material S by the fixing device 11, and cooled by the recording material cooling device 20, and the recorded material S after cooling is discharged. The discharged recording material S is stacked on the stacking unit 60.

<Recording Material Cooling Device>

Next, the recording material cooling device 20 will be described referring to FIG. 3. The recording material cooling device 20 is a belt cooling type cooling device. As shown in FIG. 3, the recording material cooling device 20 includes an endless first belt 21 and an endless second belt 25 which sandwich and conveys the recording material S in cooperation with the first belt 21. For example, the first belt 21 and the second belt 25 are made of high-strength polyimide, and have a thickness of 100 μm and a peripheral length of 942 mm. Further, the recording material cooling device 20 has a heat sink 30 which cools at least one of the first belt 21 and the second belt 25.

In this embodiment, the heat sink 30 is arranged so as to be in contact with the inner peripheral surface of the first belt 21. With this structure, the first belt 21 is cooled by the heat sink 30. Further, the second belt 25 is also cooled by the heat sink 30 by way of the nip portion with the first belt 21. As described above, the heat sink 30 may be provided only on the first belt 21, but may be provided only on the second belt 25 or on both the first belt 21 and the second belt 25.

Figure 4:
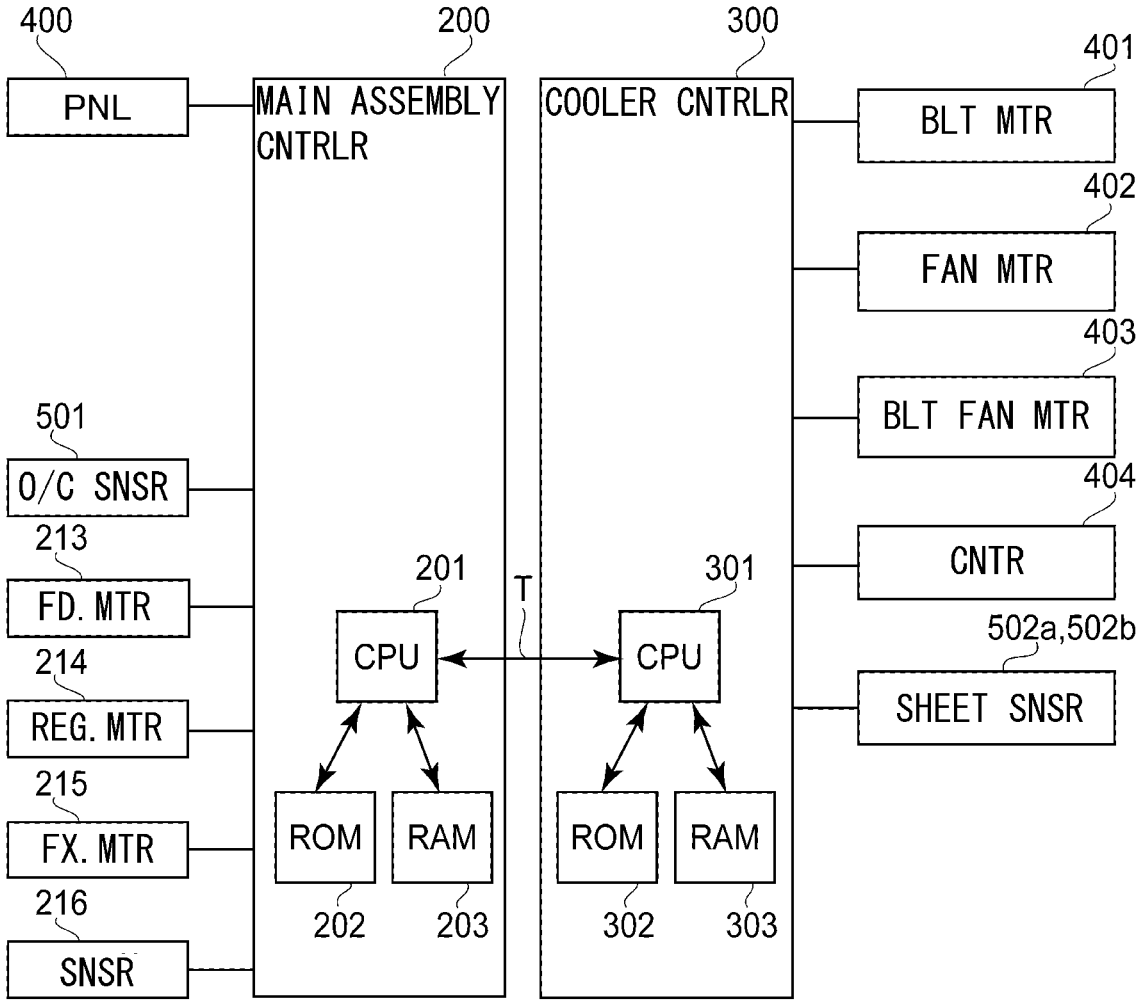
FIG. 4 is a control block illustrating a control unit.

As shown in FIG. 3, the first belt 21 as the first feed belt is trained around a plurality of first belt tension rollers 22*a* to 22*e*, and at least one of the first belt tension rollers 22*a* to 22*e* is rotated by a belt drive motor (FIG. 4). By this, the first belt 21 orbits in the direction of arrow B in the Figure. On the other hand, the second belt 25 as the second feed belt is trained around the plurality of second belt tension rollers 26*a* to 26*e* and is in contact with the first belt 21. Therefore, the second belt 25 follows the first belt 21 and rotates around. In addition, on the inner peripheral side of the second belt 25, pressure rollers 26*f* and 26*g* for pressing the second belt 25 toward the heat sink 30 are provided. The pressing rollers 26*f* and 26*g* press the second belt 25 with a pressing force of, for example, 9.8 N (1 kgf), so that the first belt 21 is assuredly contacted with the heat sink 30 by way of the second belt (more specifically, the heat receiving portion 30*a* which will be described hereinafter).

Here, the first belt 21 is driven to drive the second belt 25, but conversely, the second belt 25 is driven to drive the first belt 21. Alternatively, both the first belt 21 and the second belt 25 may be driven. In addition, when the heat sink 30 is provided so as to be into contact with the inner peripheral surface of the first belt 21, the recording material S may be contacted to the heat sink 30 by way of the first belt 21 by a plurality of feed rollers or the like instead of the second belt 25.

The recording material S on which the toner image is fixed is sandwiched between the first belt 21 and the second belt 25, and is fed in the feeding direction (arrow C direction in the Figure) by these circumferential movements. At that time, the recording material S passes through the cooling nip T4 formed by the contact between the first belt 21 and the second belt 25. In the case of this embodiment, the first belt 21 is cooled by the heat sink 30. The heat sink 30 is arranged so as to contact with the inner surface of the first belt 21 at a position where the cooling nip T4 is formed in order to efficiently cool the recording material S. The recording material S is cooled by way of the first belt 21, and the toner is fixed on the recording material S by being cooled when passing through the cooling nip T4, even if the toner on the recording material S is in a molten state before contacting the first belt 21. As an example, when the temperature of the recording material S is about 90° C. before passing through the recording material cooling device 20, the recording material S is cooled down to about 60° C. after passing through the recording material cooling device 20. As the recording material S is cooled, the toner on the recording material S is cooled.

The heat sink 30 as a cooling means is a heat radiating plate made of a metal such as aluminum. The heat sink 30 includes the heat receiving portion 30*a* for receiving the heat by contacting the first belt 21, and heat radiating portion 30*b* for radiating heat, and a fin base for conducting the heat to the heat radiating portion 30*b*. The heat radiating portion 30*b* is formed of a large number of heat radiating fins in order to increase the contact area with air and promote efficient heat radiation. For example, the heat radiation fin has a thickness of 1 mm, a height of 100 mm, and a pitch of 5 mm, and the fin base 30*c* has a thickness of 10 mm. Further, in order to forcibly cool the heat sink 30 itself, cooling fans 40*a* and 40*b* which blow air toward the heat sink 30 (specifically, the heat radiating portion 30*b*) are provided. The air flow rate of the cooling fans 40*a* and 40*b* is set to 2 m^3/min, for example.

Further, in this embodiment, in addition to cooling the first belt 21 by the heat sink 30, the belt fan 80 as a cooling means arranged on the inner peripheral side of the second belt 25 blows air toward the second belt 25, so that the second belt 25 is cooled. By cooling both the first belt 21 and the second belt 25 in this manner, the temperature of the recording material S can be lowered more efficiently.

The heat sink 30 may be brought into contact with one of the first belt 21 and the second belt 25, and the heat sink 30 is not limited to the structure provided only on the first belt 21 side as described above, but the second belt 25 may be contacted and cooled. However, in such a case, it is preferable to provide the belt fan 80 on the inner peripheral side of the first belt 21 and cool the first belt 21 by the belt fan 80. In addition, the heat sink 30 is preferably in contact with a belt (first belt 21 in this embodiment) which contacts the recording material S on the surface side on which the unfixed toner image is fixed by the fixing device 11. In this embodiment, a structure in which the first belt 21 is cooled by the heat sink 30 and a plurality of fans is shown as an example, but the first belt 21 and/or the second belt 25 may be cooled by using a belt cooling fan which blows air toward the belt, a water cooling unit or the like with which a pipe through which cold liquid is circulated is contacted with the belt.

<Control Unit>

As shown in FIG. 1, the image forming apparatus 100 includes a main assembly control unit 210 and a recording material cooling device 300. The main assembly control unit 210 will be described referring to FIGS. 1, 3 and 4. However, although various devices such as a motor and a power source for operating the image forming apparatus 100 are connected to the main assembly control unit 210 in addition to those illustrated, the illustration and description thereof will be omitted here because it is not the main purpose of the invention.

The main assembly control unit 200 as a control means performs various controls of the image forming apparatus 100 such as an image forming operation, and includes a CPU 201 (Central Processing Unit), a ROM 202, and a RAM 203. The ROM 202 stores various programs and various data required for an image forming job, for example. The CPU 201 can execute various programs stored in the ROM 202, and can execute the various programs to operate the image forming apparatus 100. The RAM 203 can also temporarily store the calculation processing results and the like relating to the execution of various programs.

The image forming job is a series of operations from the start of the image forming operation to the completion of the image forming operation based on the print signal for forming an image on the recording material S. That is, it is a series of operations from the preliminary operation (so-called pre-rotation) required for performing image formation, to the additional operation (so-called post rotation) required for ending image formation is completed through the image forming step. Specifically, it refers to the period from the pre-rotation (preparatory operation before image formation) after receiving the print signal (reception of the image formation job) to the post-rotation (operation after image formation), and includes the image formation period and the interval period between sheets.

A belt drive motor 401, a fan drive motor 402, a belt fan drive motor 403, cooling fans 40*a*, 40*b*, passage sensors 502*a* and 502*b* are connected with the main assembly control unit 210 by way of the input/output interface, the communication interface and the control unit CPU 301 of the cooling device control unit 300. Further, the main assembly control unit 200 can control the operation unit 400, and receives various program execution instructions and various data inputs by the user by way of the operation unit 400. Here, the operation unit 400 is an operation panel or an external terminal, for example. The CPU 301 can execute various programs stored in the ROM 302, and executes the various programs to operate the recording material cooling device 20. The RAM 303 can also temporarily store the calculation processing results and the like relating to the execution of various programs.

The CPU 301 mounted on the recording material cooling device 300 controls a belt drive motor 401 which drives at least one of the first belt tension rollers 22*a* to 22*d* to start or stop driving the first belt 21 or to control the movement speed thereof and so on. The CPU 301 controls the cooling fans 40*a* and 40*b* to control the start and stop of driving the cooling fans 40*a* and 40*b*, the air volume, and the like. The CPU 301 receives the detection signals of the passing sensors 502*a* and 502*b* as the recording material detecting means, and can detect the presence/absence of the recording material S in the recording material cooling device 20, that is, the stagnation of the recording material S based on the detection signals. In the case of this embodiment, the CPU 301 can detect the stagnation of the recording material S in the apparatus on the basis of comparison of the number of recording materials S passing through the inlet side of the recording material cooling device 20 and the number of recording materials S passing through the outlet side of the recording material cooling device 20.

In this embodiment, two units including the main assembly control unit 200 and the cooling device control unit 300 are provided, but one control unit may be used to control both the image forming device 100 and the recording material cooling device 200.

By the way, in the image forming apparatus 100, as described above, during the image forming operation, a so-called jam may occur in which the recording material S being fed is jammed in the feeding path 600. When a jam occurs, the feeding operation of the recording material S in the image forming apparatus is stopped. At this time, if the recording material is retained (clogged) in the transfer path 600 due to a feeding defect or the like, the stagnated recording material cannot be fed further. Therefore, the feeding of all the recording materials existing on the upstream side in the sheet feed direction with respect to the recording material staying in the feed path 600 is stopped. Here, the recording material existing on the downstream, in the sheet feed direction, of the stagnated recording material can be discharged normally, and therefore, it can be continuously discharged to the outside of the image forming apparatus 100.

As described above, when a jam occurs at any position of the feed path 600, that is, not only when the jam occurs in the recording material cooling device 20 but also when the jam does not occur in the recording material cooling device 20, the recording material S may stay in the recording material cooling device 20. Conventionally, when the jamming occurs, in the recording material cooling device 20, the first belt 21 and the second belt 25 are stopped, and the cooling fans 40*a* and 40*b* and the belt fan 80 are stopped. Therefore, in the recording material cooling device 20, the recording material S is not cooled and stayed at a high temperature. If the temperature of the recording material S remains high, the toner on the recording material S is in a molten state and may adhere to the first belt 21. Further, the longer it takes to remove the recording material S from the recording material cooling device 20, the more the temperature of the recording material staying in the recording material cooling device 20 can rise due to the influence of the temperature rise in the device main assembly 100A and the like. In such a case, in double-sided printing, for example, not only the toner on the surface side fixed immediately before can adhere to the first belt 21, but also the toner on the surface side fixed earlier may be melted and adheres to the second belt 25. The toner adhering to the first belt 21 and the second belt 25 in this manner may by redeposited onto the recording material S at the time of image formation after the jam is cleared, with the result of image defects.

<Recording Material Cooling Treatment>

Therefore, in this embodiment, when the feed of the recording material S is stopped due to jamming the like, the temperature of the recording material S staying in the recording material cooling device 20 is lowered to a predetermined temperature (for example, 70° C.) or less at which the toner on the recording material S is unlikely to adhere to the first belt 21 and the second belt 25, by continuing to drive the cooling fans 40*a* and 40*b*. Hereinafter, the recording material cooling process (cooling mode) for lowering the temperature of the recording material S will be described.

First, referring to FIG. 5 together with FIGS. 1, 3 and 4, the recording material cooling process of the Embodiment 1 will be described. The recording material cooling process of this embodiment is executed by the cooling control unit 300 with the start of the image forming job, for example, and the process ends with the end of the image forming job or the occurrence of jamming. The cooling fans 40*a* and 40*b* and the belt fan 80 are already driven before the recording material cooling process is started. Here, the recording material cooling process is a cooling process for the recording material when the recording material reaches the recording material cooling device 20, and the cooling fans 40*a* and 40*b* and the belt fan 80 have been rotated at least before the recording material reaching the nip portion of the cooling device 20. For example, the cooling fans 40*a* and 40*b* and the belt fan 80 are rotationally driven when the power of the image forming apparatus is turned on or when an image forming job is received by way of the operation unit 400 or the like.

Figure 5:
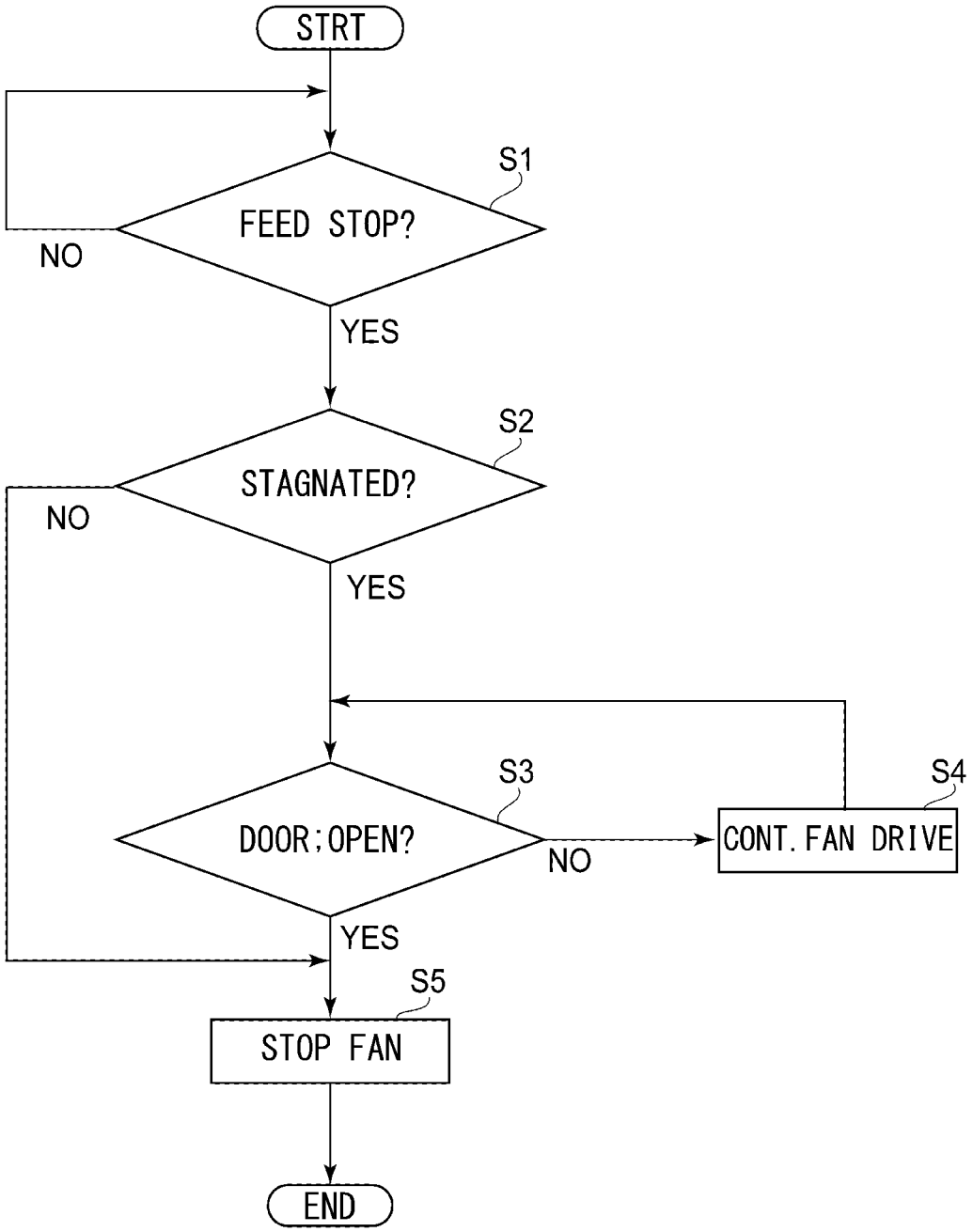
FIG. 5 is a flowchart showing the recording material cooling process of the Embodiment 1.

As shown in FIG. 5, the cooling control unit 300 determines whether or not the feeding of the recording material S has been stopped due to the occurrence of jamming in a path 600 (S1), and awaits stopping of the recording material feeding due to the occurrence of the jamming (NO in S1). Here, in the case that the passage sensors 502*a* and 502*b* detect the occurrence of the jamming, the cooling control unit 300 stops the driving of the belt drive motor 401 to stop the recording material feeding by the first belt 21 and the second belt 25. Further, in the case that the main assembly control unit 200 detects jamming in the feed path 600 by sensors (not shown) provided in various portions of the feed path 600, the cooling control unit 300 receives the jam occurrence information from the main assembly control unit 200, in response to which the drive of the belt drive motor 401 is stopped. At this time, the rotational driving of the cooling fans 40*a* and 40*b* and the belt fan 80 continues. In addition to the passage sensors 502*a* and 502*b* described above, the jam detection in step S1 can be performed by sensors (not shown) arranged at various positions in the feed path 600. When no jamming occurs, the cooling control unit 300 continues to feed the recording material S and continuously drives the cooling fans 40*a* and 40*b* and the belt fan 80.

When the jamming occurs, the cooling control unit 300 stops the feeding of the recording material S including the stopping of the first belt 21 and the second belt 52. And, when the cooling control unit 300 stops the feed of the recording material S (YES in S1), it discriminates whether or not the recording material S stagnates in the recording material cooling device 20 on the basis of the detection results of the passing sensors 502*a* and 502*b* (S2). When the recording material S is not in the recording material cooling device 20 (NO in S2), the control unit 300 stops the cooling fans 40*a* and 40*b* and the belt fan 80 (S5). That is, in such a case, no recording material S stays in the recording material cooling device 20, and therefore, the toner on the recording material S cannot adhere to the first belt 21 and the second belt 25. Therefore, the cooling control unit 300 stops the cooling fans 40*a* and 40*b* and the belt fan 80 in response to the stoppage of the feeding of the recording material S. After that, the cooling control unit 300 finishes the recording material cooling process.

On the other hand, when the recording material S is in the recording material cooling device 20 (YES in S2), the cooling control unit 300 discriminates whether or not the door is opened on the basis of the detection result of the open/close sensor 501 (S3). Then, when the door 500 is not opened (NO in S3), the cooling control unit 300 continues cooling by the cooling fans 40*a* and 40*b* and the belt fan 80 (S4). When the door 500 is opened (YES in S3), the cooling control unit 300 stops the cooling fans 40*a* and 40*b* and the belt fan 80 (S5). That is, the cooling control unit 300 continues cooling by the cooling fans 40*a* and 40*b* and the belt fan 80 until the door 500 is opened. By continuing the cooling by the cooling fans 40*a* and 40*b* and the belt fan 80, the temperature of the recording material S staying in the recording material cooling device 20 is lowered by way of the first belt 21 and the second belt 25. Here, the continuation of cooling by the cooling fans 40*a* and 40*b* and the belt fan 80 includes repeated rotation and stopping of each fan. That is, the continuation of the cooling includes such intermittent driving of the cooling fans 40*a* and 40*b* and the belt fan 80.

As described above, in this embodiment, the cooling of the recording material S by the cooling fans 40*a* and 40*b* and the belt fan 80 is not stopped but is continued at the time when the feed of the recording material S by the first belt 21 and the second belt 52 is stopped. Then, when the door 500 is opened, the cooling fans 40*a* and 40*b* and the belt fan 80 are stopped, and the cooling of the recording material S by these is finished. By continuing the cooling of the recording material S by the cooling fans 40*a* and 40*b* and the belt fan 80 in this manner, the temperature of the recording material S can be lowered. Even if the recording material stagnates in the state of being sandwiched between the first belt 21 and the second belt 25 in the recording material cooling device 20. The toner on the recording material S in the recording material cooling device 20 is cooled by lowering the temperature of the recording material S. Therefore, it is possible to prevent the toner on the recording material S from adhering to the first feed belt and/or the second feed belt.

The reason why the cooling fans 40*a* and 40*b* and the belt fan 80 are stopped upon the opening of the door 500 is that when the user opens the door 500, the recording material S remaining in the recording material cooling device 20 is removed with high possibility, and if the recording material S in the recording material cooling device 20 is removed, it is not necessary to continue cool. By this, unnecessary driving of the cooling fans 40*a* and 40*b* and the belt fan 80 can be stopped. If there is a door that is accessed when removing the recording material remaining in the recording material cooling device 20 instead of the door 500 shown in FIG. 1, the drive of the fans 40*a* and 40*b* and the belt fan 80 may be stopped, on the bias of the detection of the opening of that door. With such a structure, the cooling fans 40*a* and 40*b* and the belt fan 80 can be stopped more reliably only when the recording material in the recording material cooling device 20 is removed.

Embodiment 2

Next, the recording material cooling process of the Embodiment 2 will be described referring to FIG. 6 with FIGS. 1, 3 and 4. However, in the recording material cooling process of the Embodiment 2 shown in FIG. 6, the same processing as in the recording material cooling process of the Embodiment 1 (see FIG. 5) is designated by the same reference numerals to simplify or omit the description.

Figure 6:
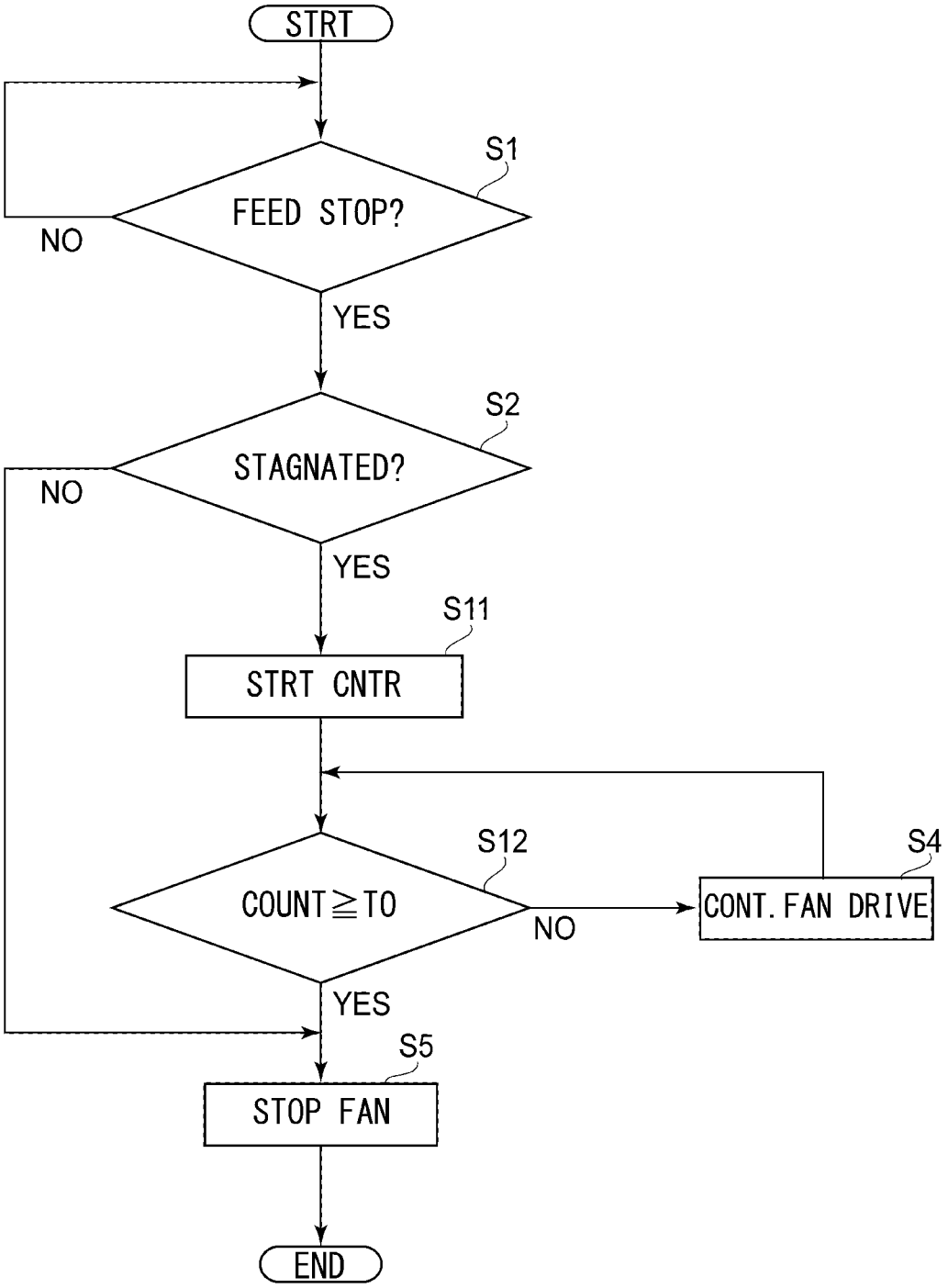
FIG. 6 is a flowchart showing the recording material cooling process of a second embodiment.

As shown in FIG. 6, the cooling control unit 300 determines whether or not the feeding of the recording material S has been stopped due to the occurrence of jam in the feed path 600 (S1), and waits (NO in S1) until the feeding of the recording material S due to the occurrence of jam stops. When the cooling control unit 300 stops the feeding of the recording material S in response to the occurrence of jam (YES in S1), the cooling control unit 300 discriminates whether or not the recording material S is retained in the recording material cooling device 20 (S2). If the recording material S is not retained (NO in S2), the cooling control unit 300 stops the cooling fans 40*a* and 40*b* and the belt fan (S5). Thereafter, the cooling control unit 300 finishes the recording material cooling process. The determinations of S1 and S2 are the same as those of the first embodiment, and therefore, the detailed description thereof will be omitted.

On the other hand, when the recording material S is retained (YES in S2), the cooling control unit 300 starts counting by a counter 404 (FIG. 4) to start counting of elapsed time from the stop of the transportation of the recording material S in the sheet passage 600 including the first belt 21 and the second belt 52 (S11). Then, the cooling control unit 300 discriminates whether or not the elapsed time from stopping the feeding of the recording material S has reached a predetermined time period or more (for example, 3 seconds or more) (S12). When the elapsed time is less than the predetermined time (NO in S12), the cooling control unit 300 continues cooling operation by the cooling fans 40*a* and 40*b* and the belt fan 80 (S4). When the elapsed time becomes not less than a predetermined time (YES in S12), the cooling control unit 300 stops the cooling fans 40*a* and 40*b* and the belt fan 80 (S5). That is, the cooling control unit 300 stops the cooling fans 40*a* and 40*b* and the belt fan 80 after elapse of a predetermined time. The predetermined time described above is selected such that the temperature of the recording material S staying in the recording material cooling device 20 lowers sufficiently down to a predetermined temperature (70° C., for example) at which the toner on the recording material S is unlikely to adhere to the first belt 21 and the second belt 25.

Figure 7:
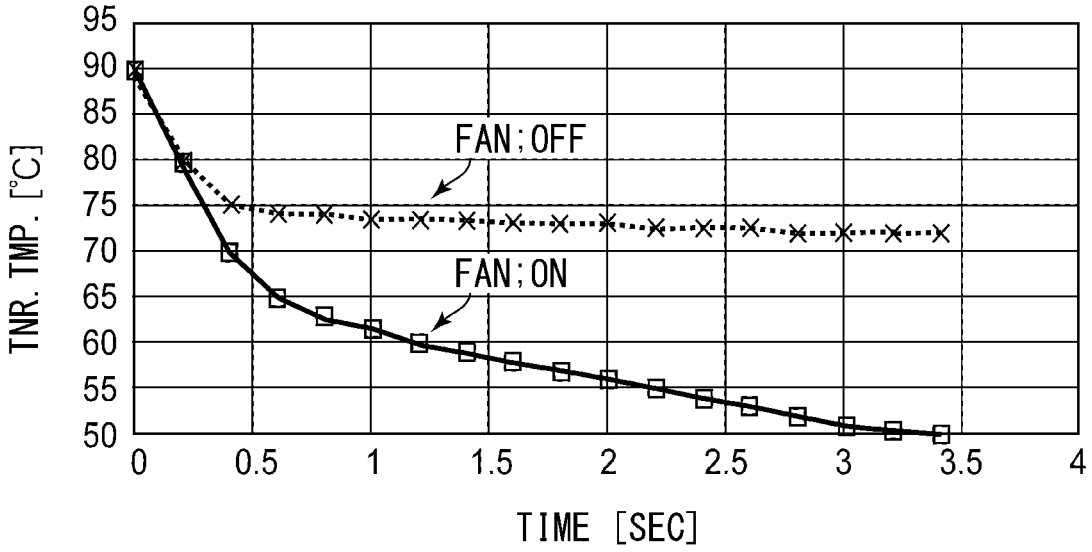
FIG. 7 is a graph showing the change of the toner temperature.

FIG. 7 shows a change of a temperature of the toner on the recording material S with time, when the cooling fans 40*a* and 40*b* and the belt fan are continuously driven with the stoppage of the recording material S, a change thereof when the cooling fans 40*a* and 40*b* and the belt fan 80 are stopped. The time transition of the toner temperature of is shown. In FIG. 7, 0 second is the time when the recording material S is stopped, the solid line shows the change in the case in which the cooling by the cooling fans 40*a* and 40*b* and the belt fan 80 is continued, and the dotted line shows the change in the case in which the cooling fans 40*a* and 40*b* and the belt fan 80 are stopped.

As will be understood from FIG. 7, when the cooling fans 40*a* and 40*b* and the belt fan 80 are stopped, the toner temperature changes at a temperature level higher than the glass transition temperature of the toner (70° C., for example). When the recording material S is sandwiched in the nip portions of the first belt 21 and the second belt 25 in this state, the toner contacts with the first belt 21 and the second belt 25 in a melted and soft state, and therefore, the toner on the recording material S adheres to the first belt 21 and the second belt 25. On the other hand, when the cooling operation by the cooling fans 40*a* and 40*b* and the belt fan 80 is continued, it is understood that the toner temperature reaches the toner glass transition temperature (70°, for example) when 0.5 seconds passes from the stop of the feeding of the recording material S, the temperature changes under the lower temperature. Therefore, in the Embodiment 2, the temperature of the recording material S staying in the recording material cooling device 20 can be lowered to a level at which toner adhesion does not occur, by continuing the cooling by the cooling fans 40*a* and 40*b* and the belt fan 80 for a predetermined time from the stop of the feed of the recording material S. In the case of the example shown in FIG. 7, the cooling operation by the cooling fans 40*a* and 40*b* and the belt fan 80 is satisfactory if it is continued for at least 0.5 seconds.

As described above, in the Embodiment 2, the cooling of the recording material S by the cooling fans 40*a* and 40*b* and the belt fan 80 is continued without stopping for a predetermined time upon the stop of the feed of the recording material S including the stop of the first belt 21 and the second belt 52. By continuing the cooling of the recording material S for a predetermined time from the stop of feeding of the recording material S, the temperature of the recording material S can be lowered the recording material S staying in the recording material cooling device 20 in the state of being sandwiched between the first belt 21 and the second belt 25. Therefore, also in the second embodiment, the toner on the recording material S staying in the recording material cooling device 20 can be suppressed from adhering to the first belt 21 and the second belt 25, as in embodiment 2.

Embodiment 3

Figure 8:
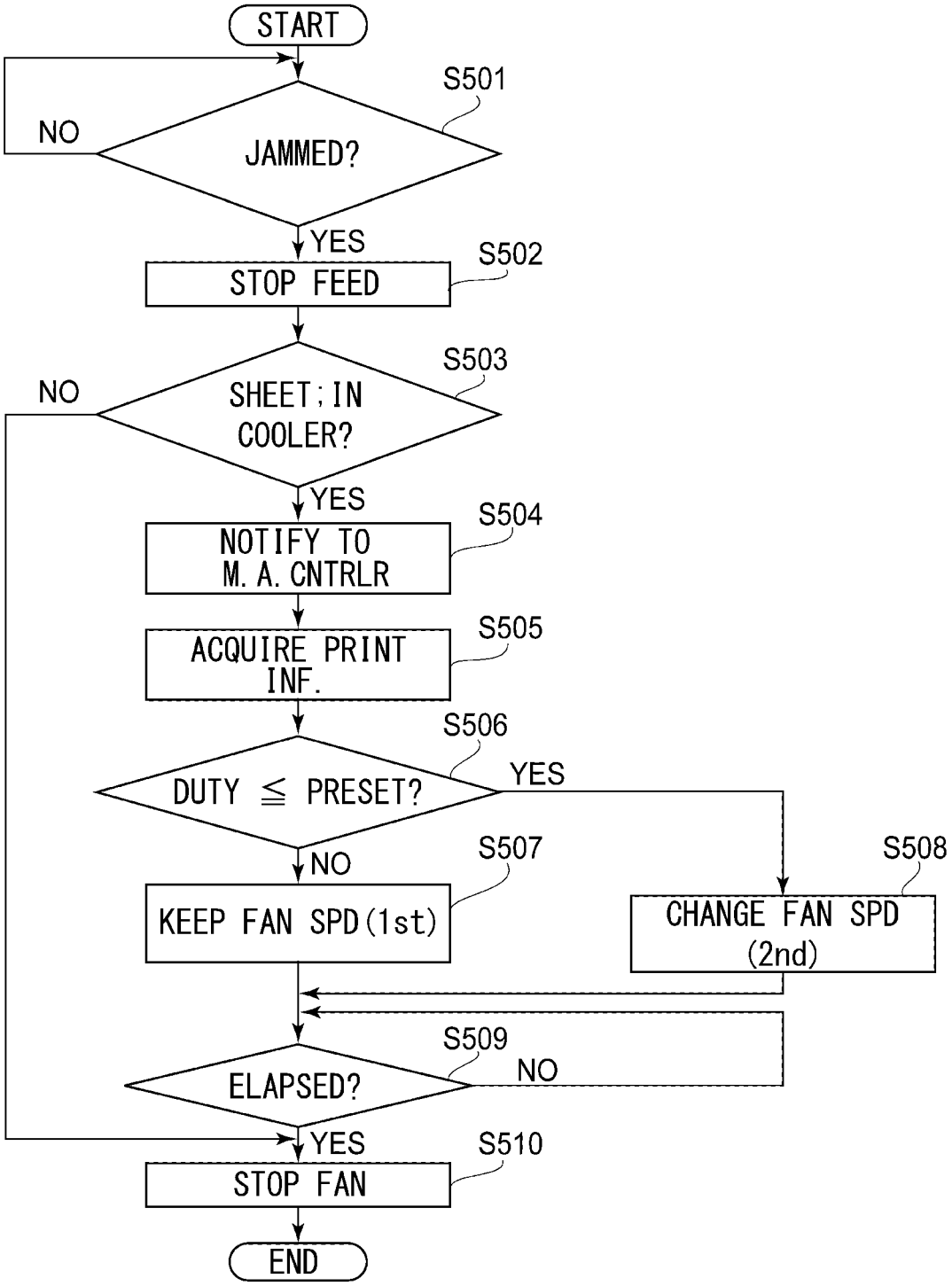
FIG. 8 is a flowchart showing the recording material cooling process of Embodiment 3.

Next, referring to FIG. 8 together with FIGS. 1, 3 and 4, the recording material cooling process of the Embodiment 3 will be described referring to FIGS. 1, 3 and 4 referring to Figure FIG. 8 is a flowchart showing a control flow of the cooling control unit 300.

The cooling control unit 300 discriminates whether or not the jam occurrence has been received by the CPU 301 from the PU 201 of the main assembly control unit 210, or the occurrence of the jam has been detected in the feed path 600 by passage sensors 502*a* and 502*b* (S501). When the jam occurs in the feed path 600 (YES in S501), the belt drive motor 401 is stopped, and the feeding operation for the recording material S by the first belt 21 and the second belt 25 is stopped (S502). Then, on the basis of the detection results of the passage sensors 502*a* and 502*b*, it is determined whether or not a recording material S remains in the recording material cooling device 20 (S503). Here, if no recording material S is in the recording material cooling device 20 (NO in S503), the CPU stops the cooling fans 40*a* and 40*b* (S5011).

Further, if the recording material S remains in the recording material cooling device (YES in S503), the stagnation of the recording material is notified to the CPU 201 provided in the main assembly control unit 210 (S504). Then, a command for acquiring the information of the recording material S accumulated in the recording material cooling device 20 is notified to the CPU in the main assembly control unit 210, and acquires, from the CPU 201, the information print information of the recording material staying in the recording material 20 (S505). Then, it is discriminated whether or not the print information (that is, the image DUTY) of the recording material S obtained from the CPU 201 is equal to or less than a predetermined value (S506), that is, the determination is made as to the change of the air flow rate (that is, rotation speed) of the belt fan 80, the cooling fans 40*a* and 40*b* for the recording material cooling device 20.

When the print information acquired in S505 is a value larger than a predetermined value (the print rate of the image is larger than 50%, for example), the rotation speeds of the cooling fans 40*a* and 40*b* and the belt fan 80 are not changed from a first speed, and the rotation is continued (S507). On the other hand, when the print information is equal to or less than a predetermined value (the image print rate is 50% or less, for example), the rotation speeds of the cooling fans 40*a* and 40*b* and the belt fan 80 are decreased to a second speed lower than the first speed (S508).

Thereafter, the cooling control unit 300 discriminates using the counter 404 whether or not a predetermined time has elapsed from the stop of feeding of the recording material (S509). Then, when the predetermined time has elapsed (YES in S509), the driving of the cooling fans 40*a* and 40*b* and the belt fan 80 is stopped. As described above, according to this embodiment, even when the feed of the recording material S is stopped in the state of being sandwiched between the first belt 21 and the second belt 25, it is possible to prevent the accumulated toner on the recording material S in the recording material cooling device 20 from adhering to the first belt 21 and the second belt 25. In addition, the driving of the cooling fans 40*a* and 40*b* and the belt fan 80 can be appropriately stopped on the basis of the print information of the recording material, and therefore, it is possible to achieve quietness.

In the above-described embodiment, when a plurality of recording materials are retained in the recording material cooling device 20 when a jam occurs in the feed path 600, the rotation speeds of the cooling fans 40*a* and 40*b* and the belt fan 80 are determined on the basis of highest image DUTY (printing rate). Further, when the toner image is not formed on the recording material retained in the recording material cooling device 20, the driving of the cooling fans 40*a* and 40*b* and the belt fan 80 may be stopped.

Other Embodiments

The recording material cooling process of the Embodiment 1 and the recording material cooling process of the Embodiment 2 may be combined. That is, in the recording material cooling process of the Embodiment 1, even if the door 500 is not opened, if the elapsed time from stopping the transportation of the recording material S exceeds a predetermined time, the cooling fans 40*a* and 40*b* and the belt fan 80 may be stopped.

In addition, the time to lower the temperature of the retained recording material S to a temperature at which toner adhesion does not occur may be long (10 seconds, for example). In such a case, the predetermined time until the cooling fans 40*a* and 40*b* and the belt fan 80 are stopped during the recording material cooling process (cooling mode) of the second embodiment described above may be set to 10 seconds or more, for example. Further, in the recording material cooling process of the Embodiment 1 described above (in the cooling mode), when the time from when the recording material S is stopped to when the door 500 is opened is less than 10 seconds or less, for example, it is not necessary to stop the cooling fans 40*a* and 40*b* and the belt fan 80 in response to the opening of the door 500. In such a case, the cooling fans 40*a* and 40*b* and the belt fan 80 are driven for a while with the door 500 open, and 10 seconds after the feeding of the recording material S is stopped, the cooling fans 40*a* and 40*b* and the belt fan 80 are stopped.

In the Embodiment 1 described above, the cooling fans 40*a* and 40*b* and the belt fan 80 are stopped in response to the opening of the door 500, but the present invention is not limited to this. For example, the cooling fans 40*a* and 40*b* and the belt fan 80 may be stopped when some user operation for recovering from the jamming is performed, such as removing the stacking unit 60 from the device main assembly 100A by the user.

In the above-described embodiment, when the recording material S is in the recording material cooling device 20, the cooling by the cooling fans 40*a* and 40*b* and the belt fan 80 is continued, but the present invention is not limited to this example. For example, regardless of whether or not the recording material S is in the recording material cooling device 20, the cooling by the cooling fans 40*a* and 40*b* and the belt fan 80 may be continued when the feeding of the recording material S is stopped.

In the above-described embodiment, cooling by both the cooling fans 40*a* and 40*b* and the belt fan 80 is continued, but the present invention is not limited to this, and only one of the cooling fans 40*a* and 40*b* and the belt fan 80 may be continuously operated.

Further, the cooling fans 40*a* and 40*b* may be temporarily stopped after the jamming occurs and before the recording material S (jammed sheet) is removed.

In such a case, in order to lower the temperature of the recording material S in the recording material cooling device 20, the driving of the cooling fans 40*a* and 40*b* may be restarted. That is, in the above-described embodiment, the cooling fans 40*a* and 40*b* that have been driven before the jamming occurs are continuously driven (S4 in FIGS. 5 and 6), but the cooling fans 40*a* and 40*b* are temporarily stopped upon the occurrence of the jamming and then it is resumed. For example, in the Embodiment 1 shown in FIG. 5, when YES is determined in S2 or NO is determined in S3, the suspended cooling fans 40*a* and 40*b* are restarted. Then, cooling by the resumed cooling fans 40*a* and 40*b* is continued until the door 500 is opened (S3 in FIG. 5) or the elapsed time exceeds a predetermined time (S12 in FIG. 6).

In the above-described embodiment, the fixing device 11 and the cooling device 20 are provided in one casing (device main assembly 100A) of the image forming apparatus 100, but the image forming portions PY, PM, PC, PK, the intermediary transfer belt 8 and the secondary transfer roller 10 are provided in a first casing, and the fixing device 11 and the cooling device 20 are provided in a second casing different from the first casing, wherein the first casing and the second casing are constitute one apparatus. The cooling device 20 described above may be used in such a manner.

Further, the structure is not limited to the above-described structure as long as it has a cooling device provided on the downstream side, in the feed direction of the recording material, of to the fixing device 11.

Figure 9:
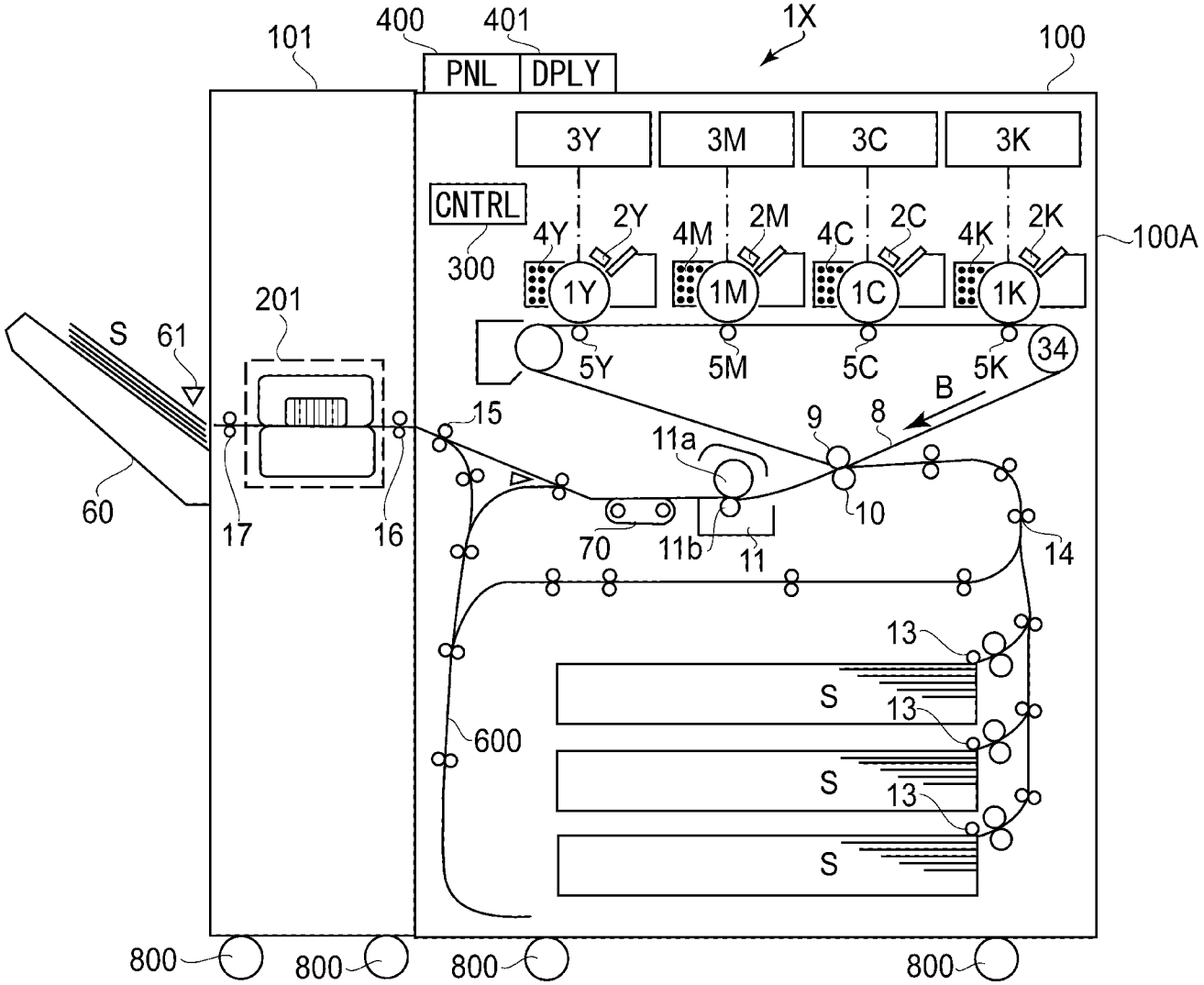
FIG. 9 is a schematic view illustrating an example of an image forming system.

For example, as shown in FIG. 9, in the recording material cooling device 201 provided in the external cooling device 101 connected to the image forming device 100, the same control as in the first to Embodiment 3 may be executed. In the image forming system 1X shown in FIG. 9, each of the image forming device 100 and the external cooling device 101 is installed on an installation surface such as a floor by a plurality of installation units 800. Here, the installation unit 800 is a caster, an installation leg, or the like.

Figure 10:
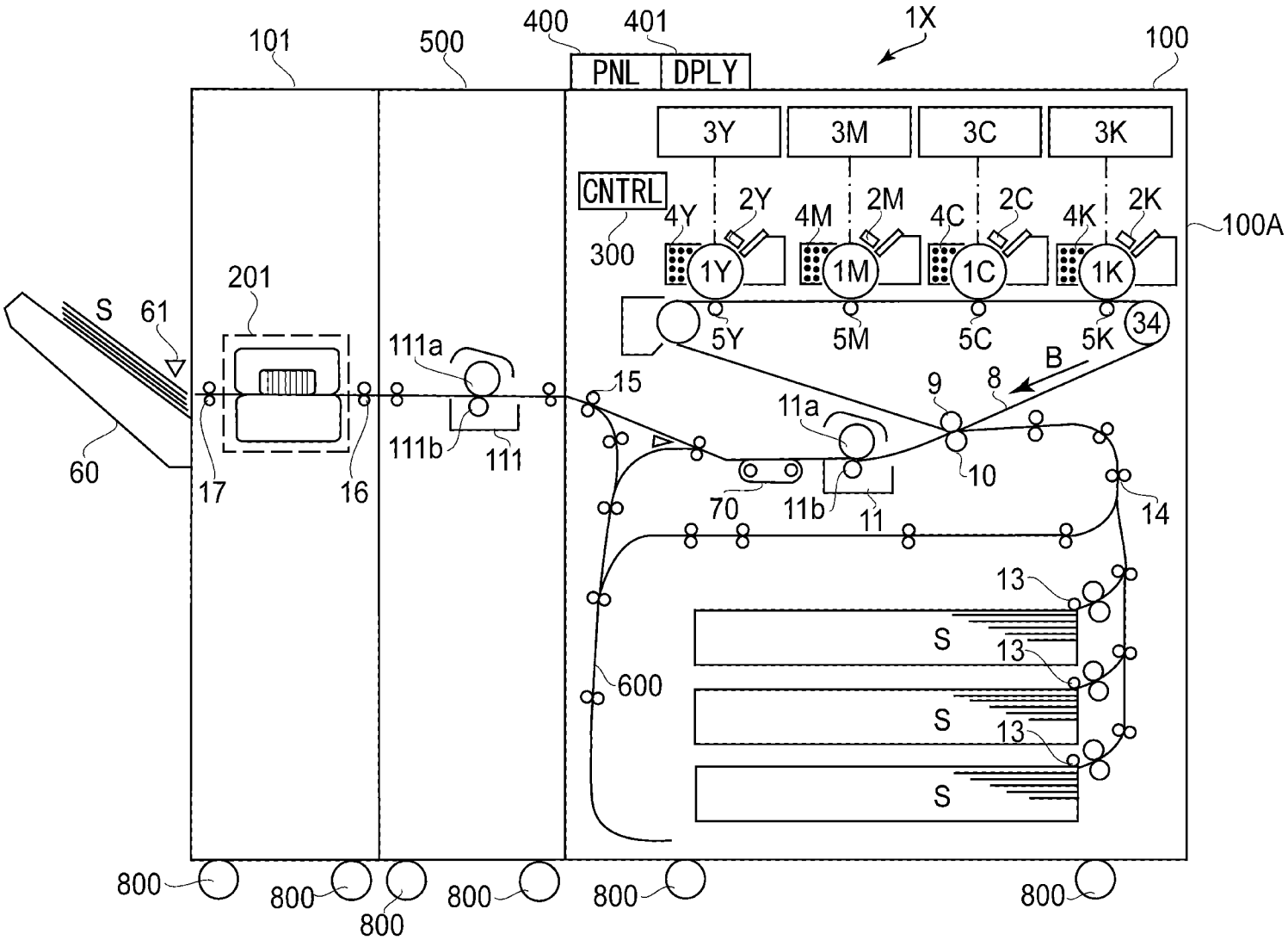
FIG. 10 is a schematic view illustrating an example of another image forming system.

Further, if the cooling device is provided on the downstream side of the fixing device in the image forming system, the same control as in the first to Embodiment 3 may be executed in the recording material cooling device 201 provided in the external cooling device connected to the further downstream side of the external fixing device 500 with respect to the recording material feeding direction, as shown in the image forming system lX illustrated in FIG. 10.

INDUSTRIAL APPLICABILITY

According to the present invention, there is provided a cooling device, an image forming apparatus, and an image forming system capable of suppressing the toner on the recording material staying in the cooling device from adhering to the feeding belt when the feeding of the recording material is stopped.

The present invention is not limited to the above embodiments, and various modifications and modifications can be made without departing from the spirit and scope of the present invention.

Therefore, the following claims are attached to make the scope of the present invention public.

The invention claimed is:

1. An image forming system comprising:

an image forming portion configured to form a toner image on a recording material;

a fixing portion configured to fix the toner image on the recording material;

a cooling device configured to cool the recording material passed through said fixing portion, said cooling device comprising:

a feeding belt;

a feeding unit cooperative with said feeding belt to nip and feed a recording material; and a cooling unit configured to cool said feeding belt; and a controlling unit capable of executing (i) a feed control for controlling said feeding belt and said feeding unit so as to feed the recording material and (ii) a cooling control for controlling said cooling unit so as to cool said feeding belt, wherein said controlling unit stops the feed control upon occurrence of abnormal feeding of the recording material in a feeding path of said image forming system, and wherein said controlling unit continues the cooling control in a case in which the recording material is nipped by said feeding belt and said feeding unit when the feed control is stopped, and said controlling unit stops the cooling control in a case in which the recording material is not nipped by said feeding belt and said feeding unit when the feed control is stopped.

2. The image forming system according to claim 1, wherein said feeding belt is a first feeding belt, and said feeding unit includes a second feeding belt cooperative with said first feeding belt to form a nip.

3. The image forming system according to claim 1, wherein said feeding unit includes a rotatable feeding roller cooperating with said feeding belt to form a nip.

4. The image forming system according to claim 1, wherein said controlling unit starts the cooling control before the recording material reaches said feeding unit.

5. The image forming system according to claim 1, wherein said controlling unit intermittently continues the cooling control in a case in which the recording material is nipped by said feeding unit and said feeding belt when the feed control is stopped.

6. The image forming system according to claim 1, wherein said controlling unit stops the cooling control after a predetermined period from stopping the feed control.

7. The image forming system according to claim 1, wherein a door detecting unit configured to detect an open state of a door provided on said image forming system, and said controlling unit stops the cooling control in a case in which opening of the door is detected by said door detecting unit.

8. The image forming system according to claim 7, wherein in a case in which opening of the door is not detected by said door detecting unit during the execution of the cooling control, said controlling unit stops the cooling control after a predetermined period from stopping the feed control.

9. The image forming system according to claim 1, further comprising heat sink contacting an inner surface of said feeding belt.

10. The image forming system according to claim 9, wherein said heat sink includes a contact surface contacting the inner surface of said feeding belt at a position of said nip and a plurality of fins, and wherein said cooling unit further includes a fan configured to blow an air to said heat sink.

11. The image forming system according to claim 10, wherein, in a case in which the recording material is nipped by said feeding belt and said feeding unit when the feed control is stopped, said controlling unit changes a rotational speed of said fan on the basis of image information on the recording material nipped by said feeding belt and said feeding unit.

12. The image forming system according to claim 11, wherein, in a case in which a print ratio of the recording material nipped by said feeding belt and said feeding unit it is not more than 50 percent, the rotational speed of said fan controlled by said controlling unit is lower than a case in which the print ratio is not less than 50 percent.

* * * * *